US008116666B2

(12) United States Patent
Teramura

(10) Patent No.: US 8,116,666 B2
(45) Date of Patent: Feb. 14, 2012

(54) DEVELOPER CONTAINER AND IMAGE FORMING APPARATUS THAT INCORPORATES THE DEVELOPER CONTAINER

(75) Inventor: Osamu Teramura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1008 days.

(21) Appl. No.: 12/030,431

(22) Filed: Feb. 13, 2008

(65) Prior Publication Data

US 2008/0193169 A1 Aug. 14, 2008

(30) Foreign Application Priority Data

Feb. 13, 2007 (JP) ..... 2007-031484

(51) Int. Cl.
*G03G 15/08* (2006.01)

(52) U.S. Cl. ..... 399/262; 399/120; 399/263

(58) Field of Classification Search ..... 399/262, 399/120, 263
See application file for complete search history.

(56) References Cited

U.S. PATENT DOCUMENTS

2002/0106215 A1* 8/2002 Ban et al. ..... 399/120
2007/0048027 A1* 3/2007 Park ..... 399/258

FOREIGN PATENT DOCUMENTS

JP 62-193262 U 12/1987
JP 7-25806 Y2 6/1995
JP 9-190064 A 7/1997
JP 11-133713 A 5/1999
JP 11-272053 A 10/1999

* cited by examiner

*Primary Examiner* — David Gray
*Assistant Examiner* — Roy Y Yi
(74) *Attorney, Agent, or Firm* — Panitch Schwarze Belisario & Nadel LLP

(57) ABSTRACT

A toner container holds toner and is detachably attached to an image forming apparatus. A housing holds the toner therein and includes a first engagement portion and an opening through which the toner is discharged into the image forming apparatus. The first engagement portion includes a first surface and either a first projection formed on the first surface or a first recess formed in the first surface. A shutter is fitted into the housing and is slidable relative to the housing. The shutter includes a second engagement portion that engages the first engagement portion when the shutter slides relative to the housing. The second engagement portion includes a second surface. Either a second projection is formed on the second surface or a second recess is formed in the second surface.

17 Claims, 15 Drawing Sheets

DEVELOPER CONTAINER AND IMAGE FORMING APPARATUS THAT INCORPORATES THE DEVELOPER CONTAINER

BACKGROUND OF THE INVENTION

1. Field of the Invention

The present invention relates to a developer container and an image forming apparatus that incorporates the developer container.

2. Description of the Related Art

Conventional electrophotographic image forming apparatus such as printers, facsimile machines, and copying machines use electrophotographic technology. A charging roller charges the circumferential surface of a photoconductive drum uniformly. An exposing unit illuminates the charged surface of the photoconductive drum in accordance with print data to form an electrostatic latent image. A developing roller supplies a developer material to the electrostatic latent image, thereby developing the electrostatic latent image into a developer image. The developer image is then transferred onto a print medium such as paper. A fixing unit fixes the developer image on the print medium into a permanent image. A developer container such as a toner cartridge holds a developer material therein and is detachably attached to the image forming apparatus.

A developer container generally includes a housing and a shutter that slidablly fits into the housing. The housing has a developer discharging opening formed therein and the shutter has another developer discharging opening formed therein. When the shutter slides to a position where the opening of the shutter is in alignment with the opening of the housing, the developer is discharged from the developer container into a developing unit of the image forming apparatus.

However, a conventional developer container suffers from a drawback in that a developer material adhering to an inner wall surface of the container may not be used efficiently.

SUMMARY OF THE INVENTION

The present invention was made in view of the aforementioned drawbacks.

An object of the invention is to provide an image forming apparatus in which the amount of a developer material adhering to the inner wall of a developer material container is minimized.

An object of the invention is to provide a developer container having an inner wall surface in which peaks and valleys are formed such that when an inner housing slides in an outer housing, vibration is generated to cause the developer material adhering to the inner wall to fall.

A developer material container holds a developer material therein, the developer material container being attached to an image forming apparatus. The container includes a housing and a shutter. The housing holds the developer material therein, the housing including a first engagement portion and an opening through which the developer material is discharged into the image forming apparatus. The first engagement portion includes a first surface. The shutter is fitted into the housing and is slidable relative to the housing. The shutter includes a second engagement portion that engages the first engagement portion when the shutter slides relative to the housing, and a shutter wall that either opens or closes the opening when the shutter slides relative to the housing. The second engagement portion includes a second surface and either at least one second projection formed on the second surface or at least one first recess formed in the second surface.

The at least one first projection projects from the first surface toward the shutter, and the at least one second projection projects from the second surface toward the housing.

The first engagement portion includes at least one second recess formed in the first surface. The at least one second projection projects from the second surface toward the housing.

The first engagement portion includes at least one first projection that projects from the first surface toward the shutter. The at least one first recess is formed in the second surface.

A developer material container holds a developer material therein, the developer material container being attached to an image forming apparatus. The container includes a housing and a shutter. The housing holds the developer material therein. The housing includes a first engagement portion and an opening formed therein through which the developer material is discharged into the image forming apparatus. The shutter is fitted into the housing and includes a shutter wall that opens and closes the opening when the shutter slides relative to the housing. The shutter includes a second engagement portion that slides on the first engagement portion. The first engagement portion slides on the second engagement portion such that the developer container vibrates.

An image forming apparatus incorporating the developer material container described above. The image forming apparatus includes:

an image bearing body;

a charging section that charges a surface of the image bearing body;

an exposing section that illuminates the charged surface of the image bearing body to form an electrostatic latent image;

a developing section that supplies the developer material to the electrostatic latent image to form a developer image;

a transfer section that transfers the developer image onto a print medium; and a fixing section that fixes the developer image on the print medium into a permanent image.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
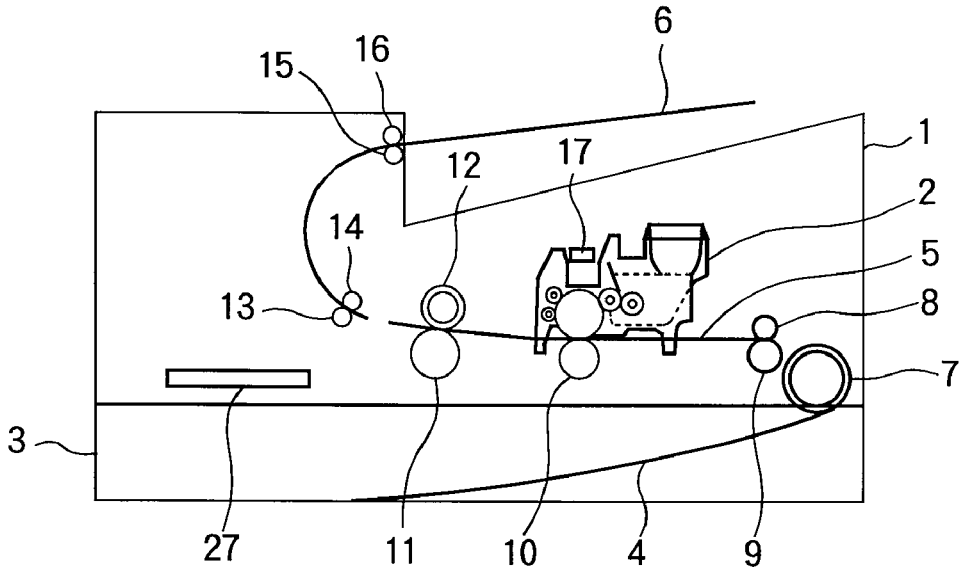
FIG. 1 is a cross-sectional view illustrating a general configuration of an electrographic image forming apparatus of a first embodiment.

FIG. 1 is a cross-sectional view illustrating a general configuration of an electrographic image forming apparatus 1 of a first embodiment.

Referring to FIG. 1, the electrographic image forming apparatus 1 incorporates a process cartridge 2 that employs electrophotographic technology to print images. The process cartridge 2 is detachably attached into the image forming apparatus 1, and functions to form a developer image (e.g., toner image). A paper cassette 3 holds a stack of print medium such as print paper. The print medium is transported through transport paths 4, 5, and 6. A hopping roller 7 feeds a top page of the stack of print medium from the paper cassette 3 into the transport path 4. Registration rollers 8 and 9 advance the print medium into the process cartridge 2 in timed relation with image formation on a photoconductive drum 25.

When the print medium passes through the process cartridge 2, the developer image is transferred on to the print medium. Then, the print medium in the transport path 5 passes through a fixing point defined between a backup roller 11 and a heat roller 12, the developer image on the print medium is fused by heat and pressure into a permanent image. Discharging rollers 13-16 transport the print medium along the transport path 6 in the image forming apparatus 1. A controller 27 performs the overall control of the image forming apparatus 1 during printing.

Figure 2:
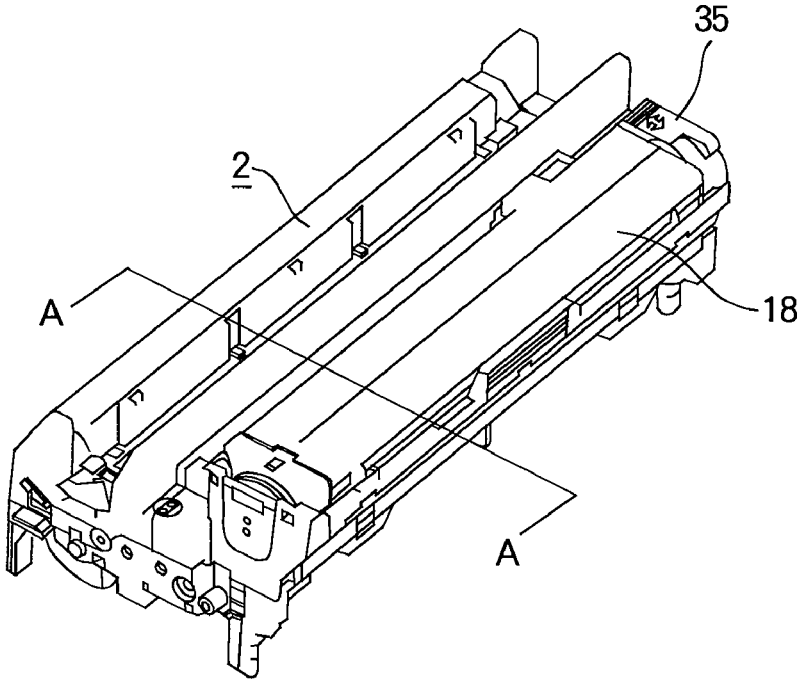
FIG. 2 is a perspective illustrating the process cartridge when the toner cartridge has been attached to the process cartridge.
Figure 3:
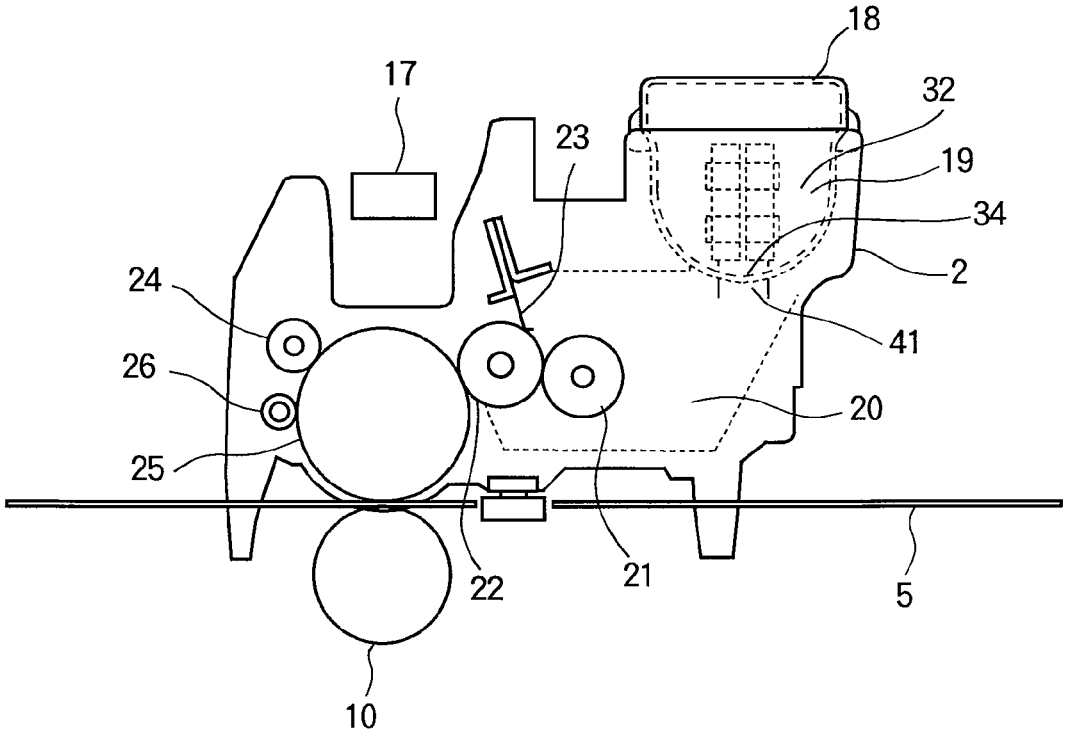
FIG. 3 is a longitudinal cross-sectional view of the process cartridge taken along a line A-A of FIG. 2.

FIG. 2 is a perspective view illustrating the process cartridge 2 when the toner cartridge 18 has been attached to the process cartridge 2. FIG. 3 is a cross-sectional view of the process cartridge 2 taken along a line A-A of FIG. 2. The toner cartridge 18 holds a developer (e.g., toner) 32 therein, and is attached to the process cartridge 2. The process cartridge 2 includes an inlet 41 that faces an outlet 34 formed in the bottom of a later described housing 28 of the toner cartridge 18.

The process cartridge 2 includes a toner reservoir 20 therein that holds the toner 32 received from the toner cartridge 18. A toner supplying roller 21 supplies the toner 32 to the surface of the developing roller 22. The developing roller 22 in turn supplies the toner 32 to the surface of the photoconductive drum 32. A developing blade 23 forms a thin layer of the toner 32 on the surface of the developing roller 22. A charging roller 24 uniformly charges the entire circumferential surface of the photoconductive drum 25. The exposing unit 17 is a printhead that takes the form of a light emitting diode (LED) head. The exposing unit 17 illuminates the charged surface of the photoconductive drum 25 in accordance with print data to form an electrostatic latent image on the charged surface of the photoconductive drum 25 (FIG. 3). The electrostatic latent image is then developed with the toner 32 into the developer image. A transfer roller 10 transfers the developer image from the photoconductive drum 25 onto the print medium in the transport path 5. A cleaning roller 26 removes the residual toner 32 from the photoconductive drum 25 after the transfer of the developer image onto the print medium.

Figure 4:
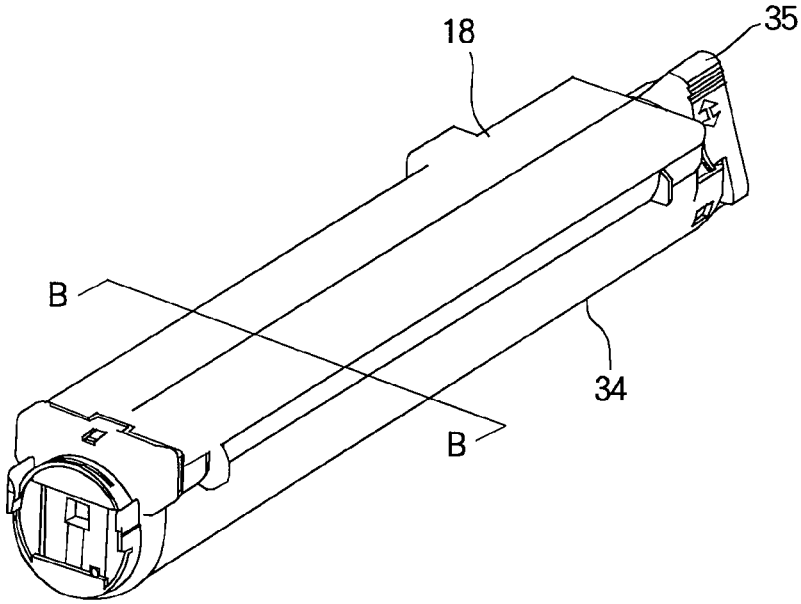
FIG. 4 is a perspective view of the toner cartridge shown in FIG. 2.
Figure 5:
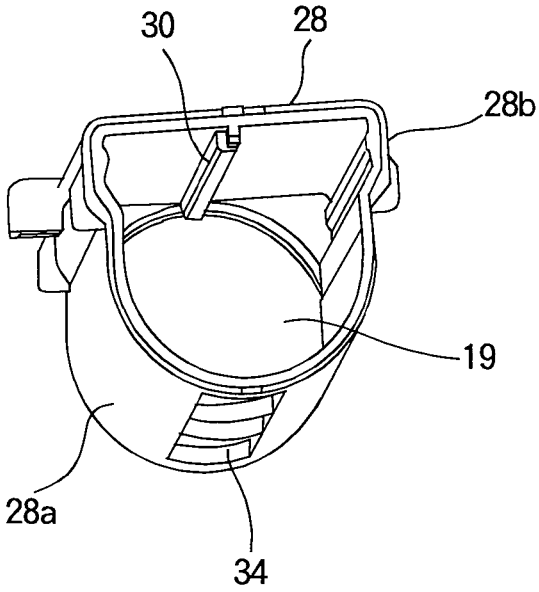
FIG. 5 is a partial perspective view of the housing on a side of the housing opposite the knob.
Figure 6:
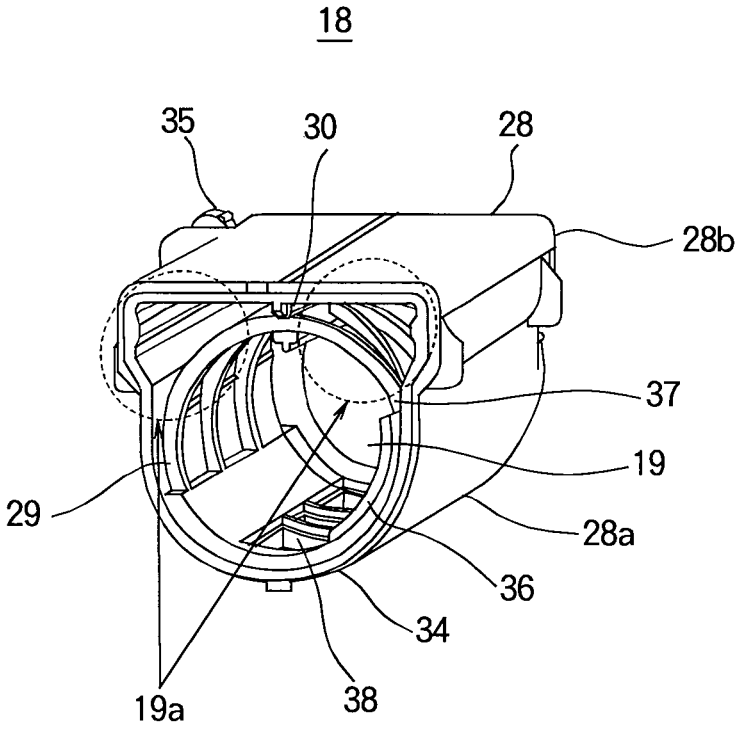
FIG. 6 is a partial perspective view of the toner cartridge.

FIG. 4 is a perspective view of the toner cartridge 18 shown in FIGS. 2 and 3. FIG. 5 is a partial perspective view of a portion on a side of the housing 28 opposite a knob 35. FIG. 6 is a partial perspective view of the toner cartridge 18 near the knob 35.

The housing 28 has a longitudinally extending semi-cylindrical lower half 28*a* and a longitudinally extending rectangular parallelpiped upper half 28*b*. The cylindrical lower half 28*a* is contiguous with rectangular parallelpiped upper half 28*b*. The rectangular parallelpiped upper half 28*b* provides spaces 19*a* (FIG. 6) for greater toner holding capacity. The outlet 34 is formed in the bottom of the lower half 28*a*.

Figure 7:
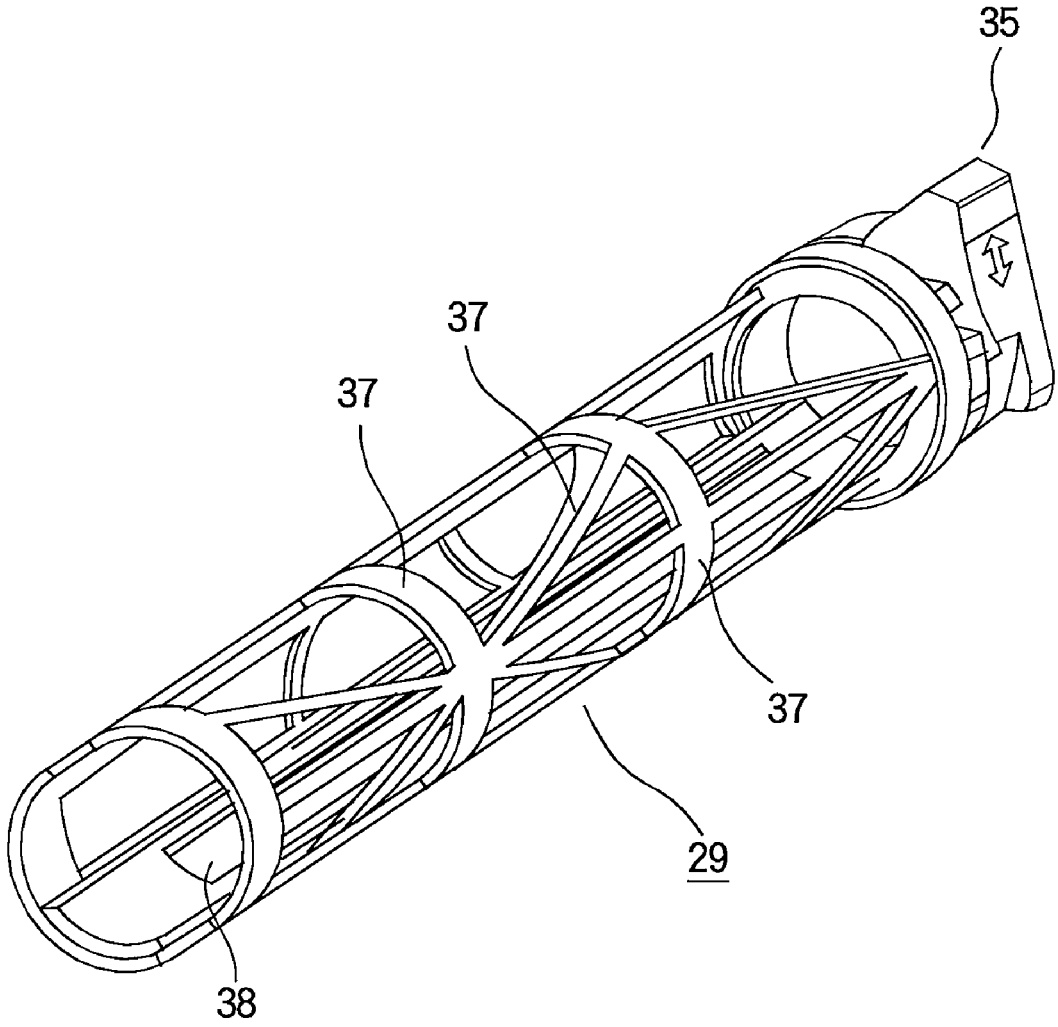
FIG. 7 is a perspective view of the shutter.

FIG. 7 is a perspective view of the shutter 29.

A shutter 29 has a generally cylindrical shape, and is received in the housing 28 such that the shutter 29 is in sliding contact with the inner wall surface of the lower half 28*a*.

The rotary knob 35 is formed in one piece with the shutter 29 or is securely assembled to the shutter 29, and is at a longitudinal end of the toner cartridge 18. Operating the rotary knob 35 to an opening position causes a shutter portion 36 to open the outlet 34, allowing the toner 32 to be supplied into the toner reservoir 20 of the process cartridge 2. Operating the knob 35 to a closing position causes the shutter portion 36 to close the outlet 34, stopping supply of the toner 32 into the toner reservoir 20 and locking the toner cartridge 18 to the process cartridge 2. Curved guides 37 have one or more projections 31 (FIG. 8) formed on the outer curved surfaces 37*a* but are not shown in FIG. 7 for the sake of simplicity.

Figure 8:
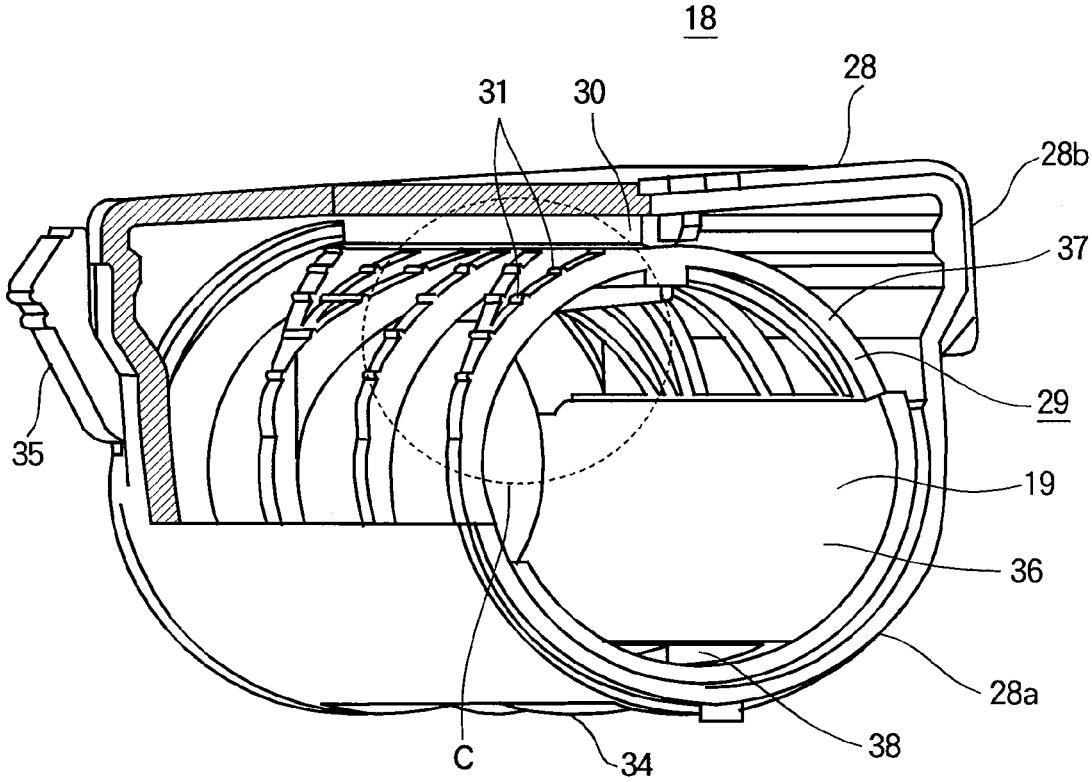
FIG. 8 is a partial perspective view of the housing shown in FIG. 6 with a part of the housing cut away.

FIG. 8 is a partial perspective view of the housing 28 shown in FIG. 6 with a part of the housing 28 cut away.

The shutter 29 includes the shutter portion 36 in the shape of a partial cylindrical wall and curved guides 37 in the shape of a partial ring or an arc. When the shutter 29 rotates in the housing 28, the shutter portion 36 rotates in sliding contact with the inner wall of the cylindrical lower half 28*a*. A sealing member (not shown) formed of a resilient material may be attached to the outer surface of the shutter portion 36. The curved guides 37 have one or more projections 31 formed on the outer curved surfaces 37*a*. The outer curved surfaces 37*a* lie in a substantially cylindrical plane in which the outer surface of the shutter portion 36 lies. The projections 31 project substantially radially toward the housing 28 and extend in a direction parallel to a rib 30 formed on an upper inner surface of the rectangular parallelpiped upper half 28*b*.

A toner-discharging opening 38 is formed in the shutter 29 adjacent to the shutter portion 36. When the shutter 29 rotates relative to the housing 28 to the opening position, the toner-discharging opening 38 becomes aligned with the outlet 34 formed in the bottom wall of the housing 28. The toner-discharging opening 38 is made sufficiently larger than the outlet 34.

The toner cartridge 18 includes a toner chamber 19 (FIGS. 5 and 6) that holds the toner 32 therein. When the rotary knob 35 is rotated to the opening position, the shutter portion 36 opens the outlet 34 so that the developer 32 is discharged from the toner chamber 19 through the outlet 34 into a toner reservoir 20 of the process cartridge 2. When the knob 35 has been rotated completely to the opening position, a later described locking mechanism completely locks the toner cartridge 18 to the process cartridge 2.

Figure 9:
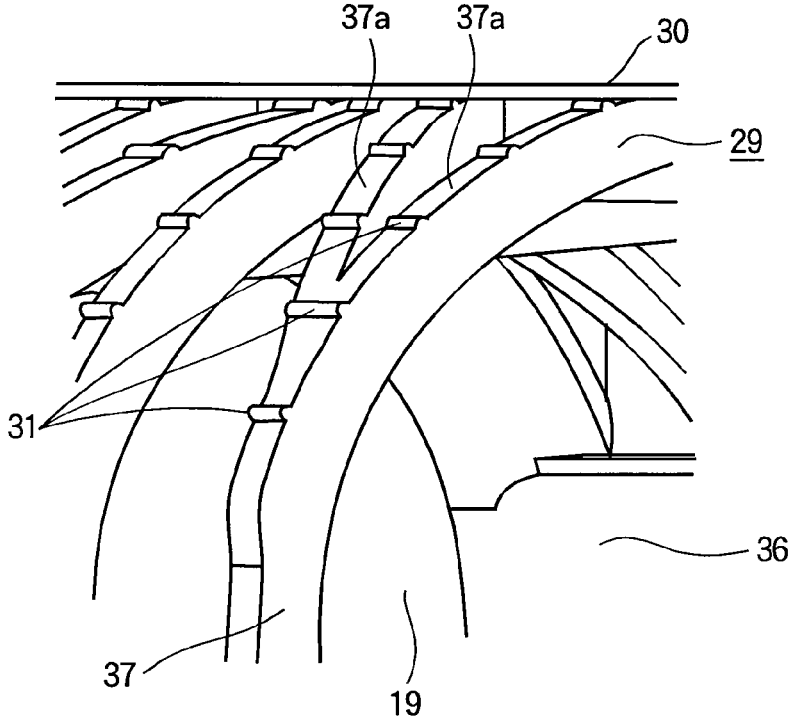
FIG. 9 is an enlarged view of a portion C of FIG. 8.

FIG. 9 is an enlarged view of a portion C of FIG. 8. Referring to FIGS. 5-9, the housing 28 further includes the rib 30 formed on the upper inner surface of the rectangular parallelpiped upper half 28*b*. The rib 30 extends in the longitudinal direction of the housing 28 and extends toward the shutter 29. The rib 30 contacts the curved guides 37 of the shutter 29 and cooperates with the lower half 28*a* to hold the shutter 29 in place. In other words, when the shutter 29 rotates in the housing 28, the shutter 29 is guided by the rib 30 and the lower half 28*a*. One or more of the ribs 30 may be provided for greater effect.

Figure 10:
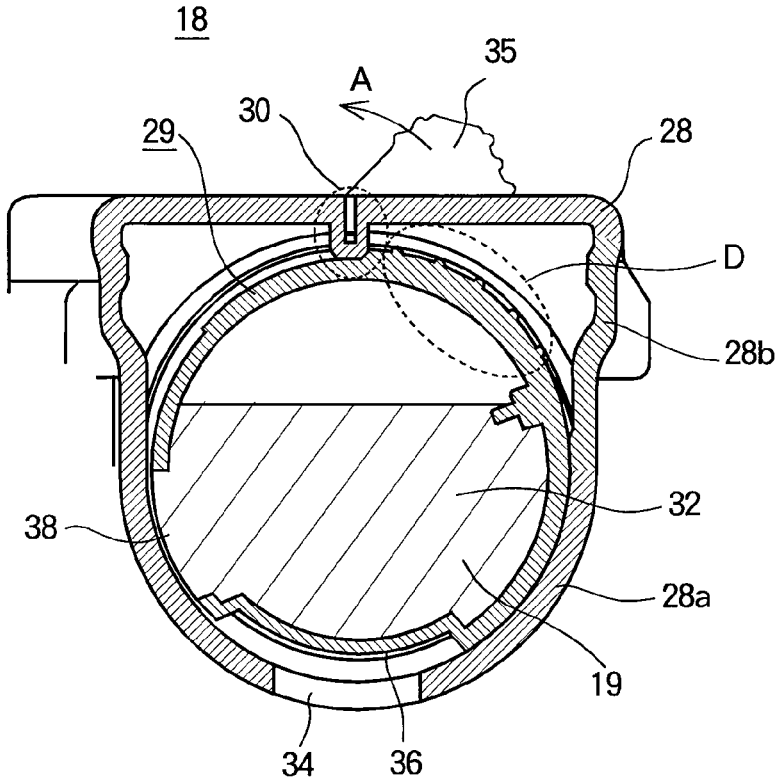
FIG. 10 is a cross-sectional view of the toner cartridge taken along a line B-B of FIG. 4.
Figure 11:
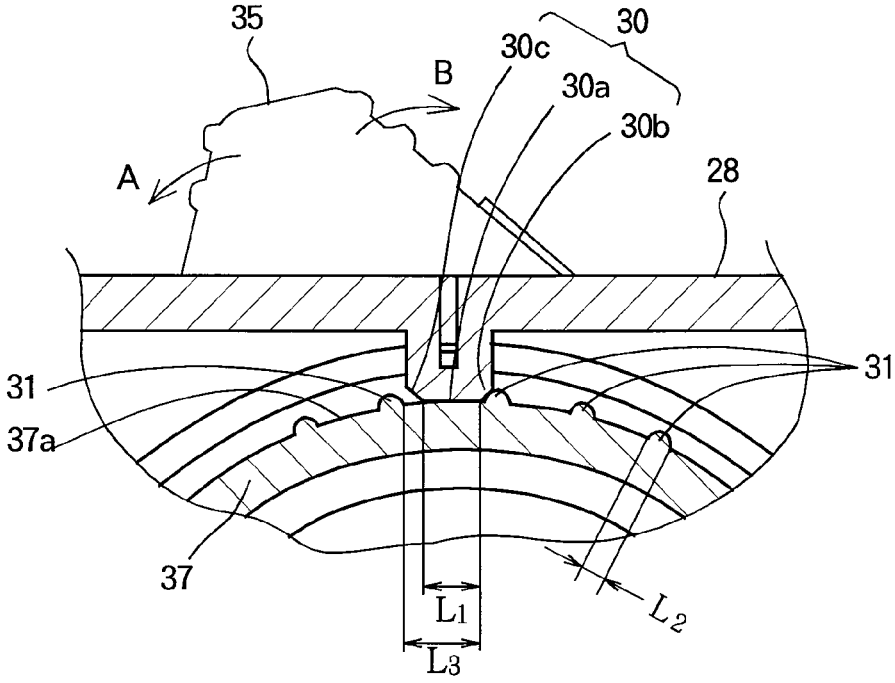
FIG. 11 is an enlarged cross-sectional view of a pertinent portion when the knob shown in FIG. 10 is rotated in a direction shown by arrow A.

FIG. 10 is a cross-sectional view of the toner cartridge 18 taken along a line B-B of FIG. 4. FIG. 11 is an enlarged partial cross-sectional view of a pertinent portion D of FIG. 10 when the knob 35 shown in FIG. 10 is rotated in a direction shown by arrow A.

The rib 30 includes a flat surface 30*a* and side surfaces 30*b* and 30*c* contiguous to the flat surface 30*a*. The side surfaces 30*b* and 30*c* form a tapered portion of the rib 30 (FIG. 11). The projections 31 are semi-cylindrical projections having a substantially semicircular cross section. The rib 30 engages the curved guides 37 such that the rib 30 and the curved guides 37 guide the rotation of the shutter 29 when the shutter 29 rotates relative to the housing 28. When the shutter 29 rotates, the projections 31 interfere with the rib 30 and are then pressed by the rib 30 so that the curved guides 37 resiliently deform in a direction away from the rib 30. The deformation of the curved guides 37 causes the projections 31 to slip over the rib 30 into disengagement from the rib 30. Shortly after the projections 31 disengage from the rib 30, the outer curved surfaces 37*a* of the curved guides 37 slide on the rib 30, vibrating due to abrupt disengagement of the projections 31 from the rib 30. The side surfaces 30*b* help the projections 31 climb over the rib 30. It is to be noted that when the rib 30 is between adjacent projections 31, the curved guides 37 are in contact with the flat surface 30*a* of the rib 30 but are not deformed significantly.

The projections 31 are formed on the outer curved surface 37*a* of each of the curved guides 37. While a plurality of projections 31 are used in the first embodiment, any number of inner projections 31 may be used.

The flat surface 30*a* of the projection 30 includes a dimension L1 in a direction of rotation of the curved guides 37, the dimension L1 being greater than a dimension of the projection 31 in the direction of rotation of the curved guides 37. The projections 31 are spaced apart by a distance L3, which is longer than the dimension L1 of the flat surface 30*a* of the rib 30. Thus, when the shutter 29 rotates relative to the housing 28, the rib 30 will not extend over two adjacent projections 31 simultaneously at any moment, thereby generating a sufficient amount of vibration of the shutter 29 shortly after projection 31 disengages from the rib 30. Providing that the aforementioned conditions are met, the cross section of the inner projections 31 may have a radius of 0.2 mm, the flat surface 30*a* may have a dimension of 3 mm in the direction of rotation of the curved guides 37, and the rib 30 may project by 2.6 mm from the inner wall surface of the housing 28. Further, the projections 31 may have a radius of 0.12 mm or 0.05 mm.

The toner cartridge 18 includes a locking mechanism that locks the toner cartridge 18 to the image forming apparatus in interlocked relation with the rotation of the knob 35.

Figure 12:
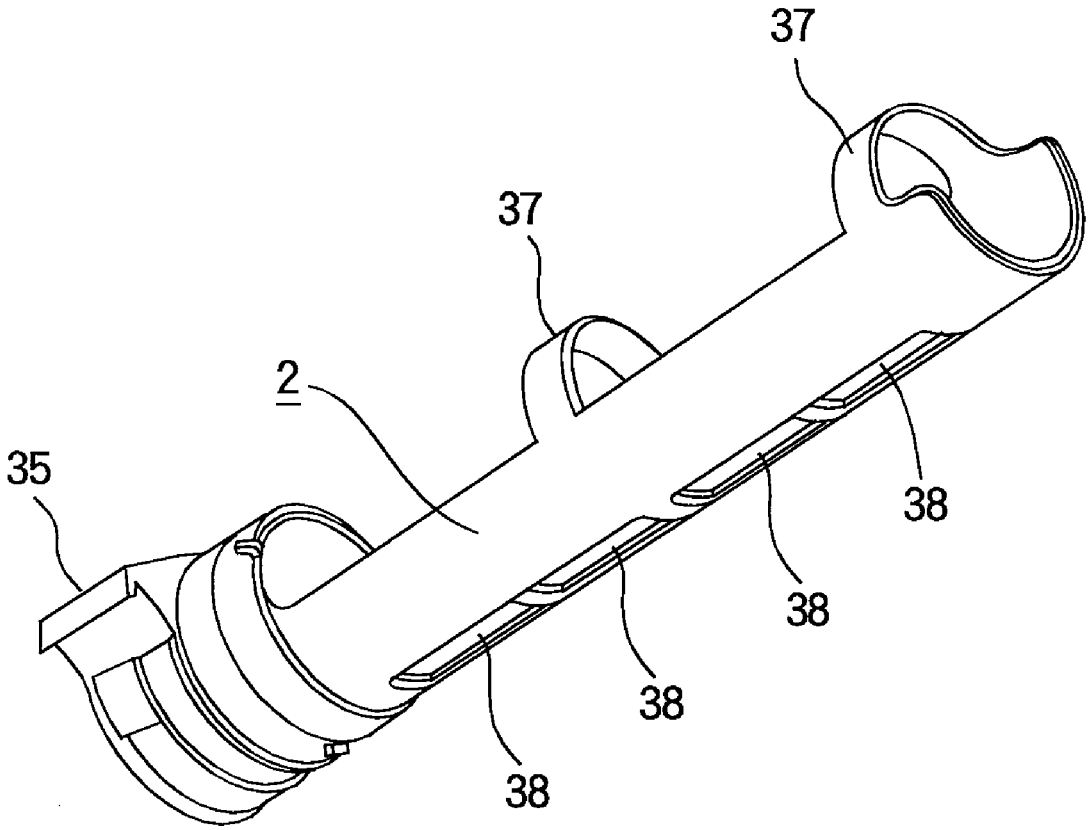
FIG. 12 illustrates the curved guides in the shape of a short cylinder.

FIG. 12 illustrates the curved guides 37 in the shape of a short cylinder. The curved guides 37 may also be in the shape of a short cylinder. However, a short cylindrical guide 37 has high rigidity and therefore may be difficult to deform when the projections 31 abuts the projection 30 during rotation of the shutter 29 relative to the housing 28. Thus, the short cylindrical guide 37 is difficult to vibrate with sufficient amplitude during rotation of the shutter 29. If the projection 31 formed on the short cylindrical guide 37 are small, the amplitude of vibration is also small. Therefore, the curved guides 37 are preferably in the shape of a partial ring or an arc rather than in the shape of a substantial short cylinder. In order to generate vibration, at least one projection 31 needs to be formed on at least one of the curved guides 37. However, one or more of the projections 31 should be formed on one or more of the curved guides 37 for a sufficient amount of vibration.

{Locking Mechanism}

The locking mechanism for locking the toner cartridge 18 to the process cartridge 2 will be described with reference to FIGS. 13, 14, and 15A-15C.

Figure 13:
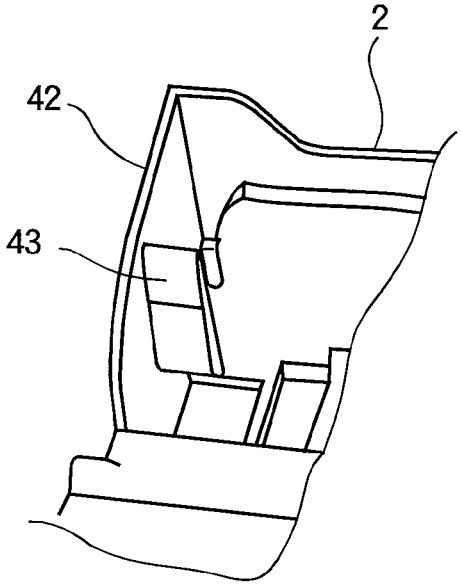
FIG. 13 is a perspective view illustrating a portion of the locking mechanism on the process cartridge side.

FIG. 13 is a perspective view illustrating a pertinent portion of the locking mechanism on the process cartridge side.

Figure 14:
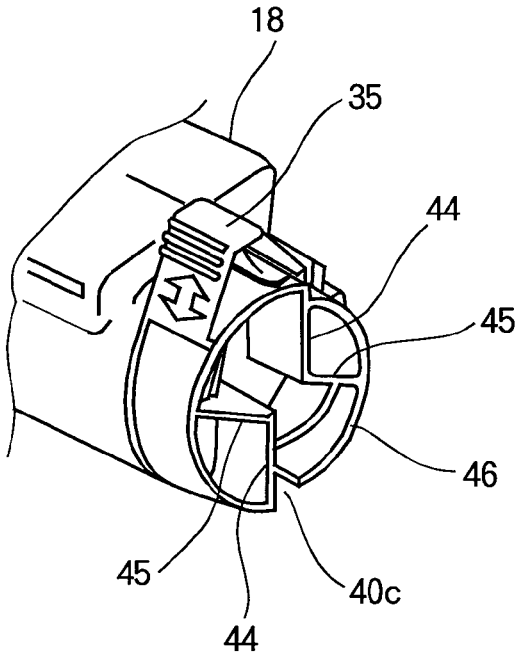
FIG. 14 is a perspective view of a portion of the locking mechanism on the toner cartridge side.

FIG. 14 is a perspective view of a pertinent portion of the locking mechanism on the toner cartridge side.

Figure 15C:
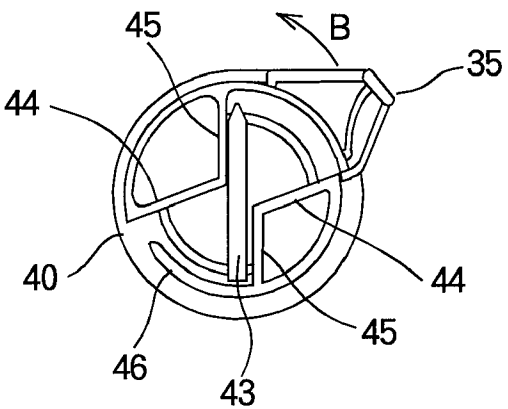
FIG. 15C is a front view of the toner cartridge when the knob has been rotated from the position shown in FIG. 15B to an opening position.
Figure 15B:
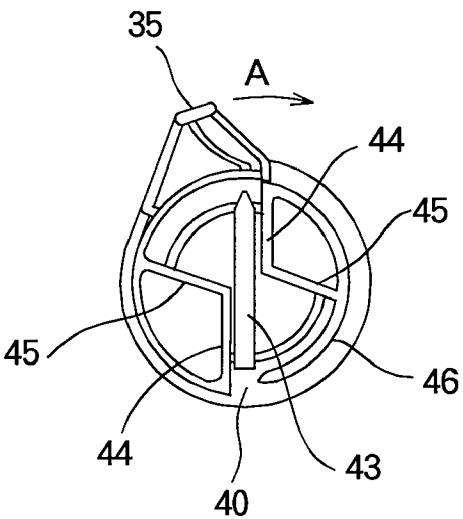
FIG. 15B is a front view of the toner cartridge after the toner cartridge has been attached to the process cartridge.
Figure 15A:
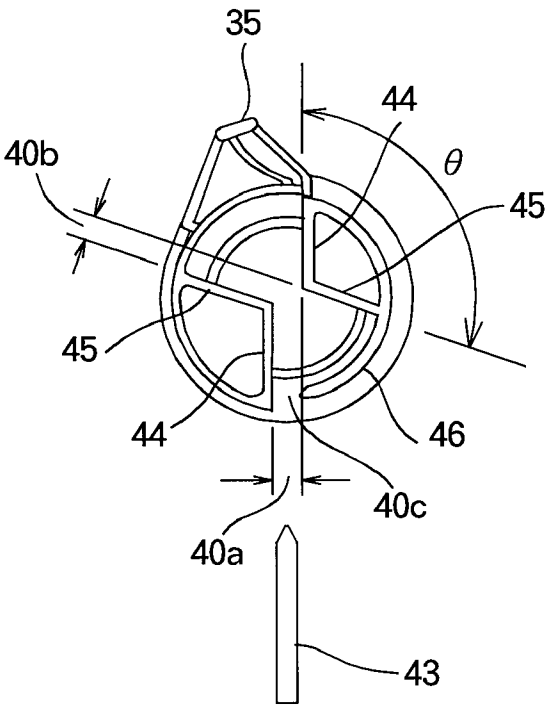
FIG. 15A is a front view of the toner cartridge before the toner cartridge is attached to the process cartridge.

FIG. 15A is a front view of the toner cartridge 18 before the toner cartridge 18 is attached to the process cartridge 2.

FIG. 15B is a front view of the toner cartridge 18 shortly after the toner cartridge 18 has been attached to the process cartridge 2.

FIG. 15C is a front view of the toner cartridge 18 when the knob 35 has been rotated from the position shown in FIG. 15B to the opening position (i.e., locking position).

Referring to FIG. 13, a plate-like guide projection 43 is formed on the inner wall surface of the process cartridge 2 and extends in a longitudinal direction. When the toner cartridge 18 is attached to the process cartridge 2, the guide projection 43 enters the toner cartridge 18 such that the toner cartridge 18 is guided into the process cartridge 2 in the correct orientation. The knob 35 includes two pairs of guide walls, each pair including a guide wall 44 and a guide wall 45 contiguous with the guide wall 44 to form an obtuse angle θ therebetween. The two pairs are arranged at one longitudinal end of the shutter 29 such that they are diametrically opposite to each other. The guide walls 44 define a gap 40*a* therebetween and the guide walls 45 define a gap 40*b* therebetween as shown in FIG. 15A. The knob 35 includes an opening 40*c* (FIG. 14) between a hook 46 and one of the guide walls 44. As a user lowers the toner cartridge 18 into the process cartridge 2 from above, the guide projection 43 enters the gap 40*a* through the opening 40*c* to guide the toner cartridge 18 into the process cartridge 2. In this manner, the toner cartridge 18 may be placed in position.

When the knob 35 is rotated in a direction shown by arrow A in FIG. 15B after the toner cartridge 18 has been placed in position, the user operates the knob 35 to rotate the shutter 29 relative to the housing 28, so that the guide walls 44 rotate away from the guide projection 43. As the knob 35 rotates, a locking hook 46 enters under the guide projection 43 while the shutter portion 36 gradually opening the outlet 34. Further rotating the knob 35 causes the guide walls 45 to abut the guide projection 43 so that the shutter 29 cannot rotate any further.

When the guide walls 45 abut the guide projection 43 to prevent further rotation of the shutter 29, the opening 38 becomes aligned with the outlet 34. The locking hook 46 engages the guide projection 43 to fix the toner cartridge 18 with respect to the process cartridge 2. When the toner cartridge 18 is to be detached from the process cartridge 2, the aforementioned procedure is reversed. The user first operates the knob 35 to the closing position. In other words, the user rotates the knob 35 in a direction shown by arrow B in FIG. 15C until the knob 35 cannot rotate any further, and then pulls the entire toner cartridge 18 upward, thereby taking the toner cartridge 18 out of the process cartridge 2.

Figure 16C:
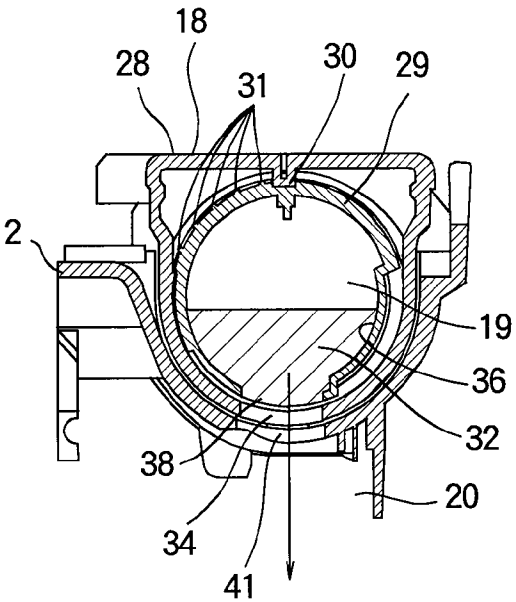
FIG. 16C is a cross sectional view of the toner cartridge and the process cartridge when the knob is operated to the opening position.
Figure 16B:
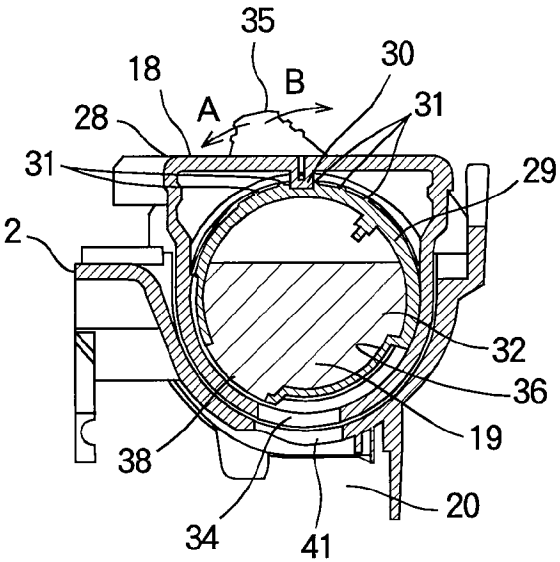
FIG. 16B is a cross sectional view of the toner cartridge and the process cartridge when the knob is operated toward the opening position, but shortly before the discharging opening is opened.
Figure 16A:
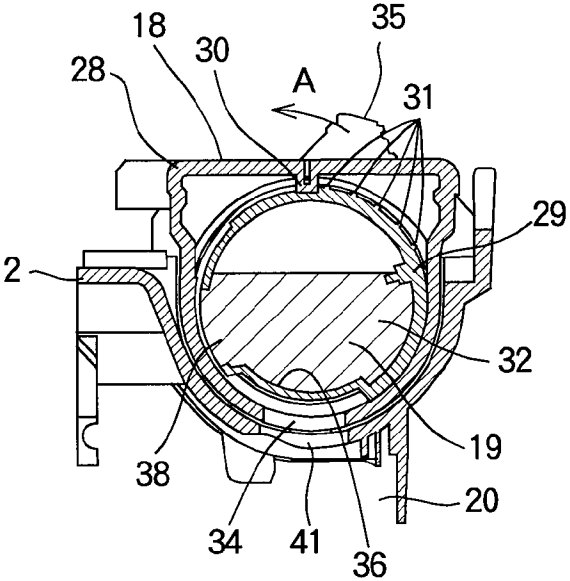
FIG. 16A is a cross sectional view of the toner cartridge and the process cartridge shortly after the toner cartridge has been attached to the process cartridge.

FIG. 16A is a cross sectional view of the toner cartridge 18 and the process cartridge 2 shortly after the toner cartridge 18 has been attached to the process cartridge 2.

FIG. 16B is a cross sectional view of the toner cartridge 18 and the process cartridge 2 when the knob 35 is operated toward the opening position, but is stopped shortly before the discharging outlet 34 is opened.

FIG. 16C is a cross sectional view of the toner cartridge 18 and the process cartridge 2 when the knob 35 is operated to the opening position so that the discharging outlet 34 is opened completely.

Referring to FIG. 16A, the toner cartridge 18 has been attached to the process cartridge 2 so that the outlet 34 formed in the housing 28 is in alignment with the inlet 41 formed in the process cartridge 2. The shutter portion 36 is at the closing position before the toner 32 is discharged into the process cartridge 2, i.e., the shutter portion 36 faces the outlet 34 formed in the bottom wall of the toner cartridge 18, and therefore the toner chamber 19 is full of the fresh toner 32.

Referring to FIG. 16B, rotating the knob 35 in the A direction, the shutter portion 36 rotates in sliding contact with the inner surface of the housing 28, gradually opening the outlet 34 to discharge the fresh toner 32 into the toner reservoir 20. At the same time, the locking hook 46 enters under the guide projection 43 to lock the toner cartridge 18 to the process cartridge 2.

When the curved guides 37 slide on the rib 30, the rib 30 interferes with the projections 31 so that rib 30 exerts an increased force against the projections 31. As the user further rotates the knob 35 to overcome the increased force, the curved guides 37 is caused to temporarily deform until the rib 30 takes up a position between adjacent projections 31 formed on each of the curved guides 37. As a result, the shutter 29 is subjected to a short vibration.

Because the rib 30 interferes with a plurality of projections 31 formed on the outer curved surface 37*a* of the curved guides 37, both the shutter 29 and the housing 28 experience a series of short vibrations. The series of short vibrations effectively shakes the toner off various portions of the toner cartridge 18, including the inner wall of the housing 28, upper corners of the housing 28, and outer curved surface 37*a* of the curved guides 37. This operation reduces the amount of toner 32 that would otherwise remain in the toner chamber 19 after discharging the toner 32 into the process cartridge 2.

Rotating the knob 35 in the B direction causes the shutter portion 36 to start closing the outlet 34, causes the shutter portion 36 to gradually cease the supply of the toner 32 into the process cartridge 2, and causes the locking hook 46 to start exiting from under the guide projection 43.

Referring to FIG. 16C, when the knob 35 has been rotated in the A direction completely, the opening 38 is in alignment with the outlet 34, i.e., the discharging outlet 34 has been opened completely. Thus, the toner 32 is supplied from the toner chamber 19 into the toner reservoir 20, and the locking mechanism locks the toner cartridge 18 to the process cartridge 2 completely.

Prior to replacement of the toner cartridge 18 by a new, unused one, the knob 35 is rotated completely in the B direction so that the shutter portion 36 completely closes the outlet 34 and the locking mechanism causes the toner cartridge 18 to be unlocked from the process cartridge 2. Then, the toner cartridge 18 may be taken out of the process cartridge 2.

The toner cartridge 18 includes rib-shaped portions at various locations inside the housing 28, and the toner is apt to remain on or adhere to the rib-like portions. In order to effectively reduce residual toner remaining in the toner cartridge 18, it is desirable to configure the toner cartridge 18 such that the rib-like portions vibrate with large amplitudes. The structure of the embodiment effectively generates large amplitudes of vibration of the rib-like portions, preventing the toner 32 from remaining within the toner cartridge 18.

Modification to the First Embodiment

Figure 17:
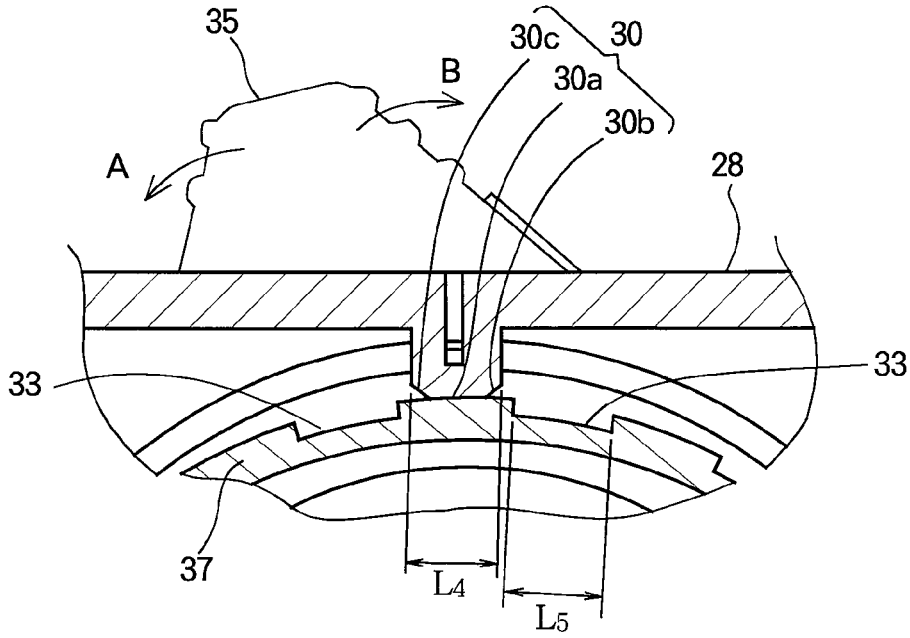
FIG. 17 illustrates a modification to the shape of the recess.

FIG. 17 illustrates a modification to the shape of the recess 33. Referring to FIG. 17, the recess 33 has a rectangular cross section. Dimensions L4 and L5 are related such that L5>L4.

Figure 18:
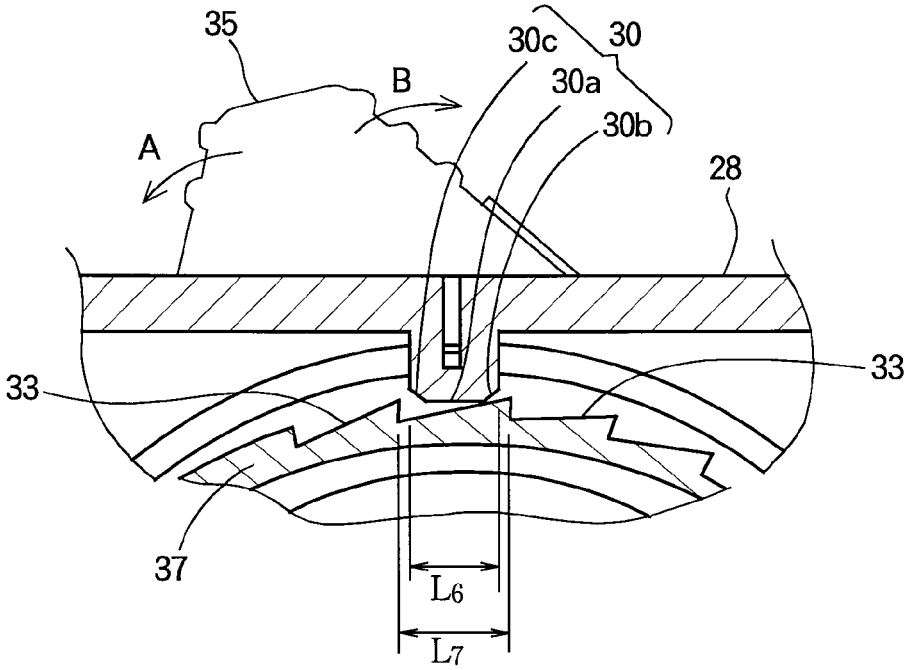
FIG. 18 illustrates another modification to the shape of the recess.

FIG. 18 illustrates another modification to the shape of the recess 33. Referring to FIG. 18, the recess 33 has a cross section in the shape of a saw-tooth. Dimensions L6 and L7 are related such that L7>L6.

Figure 19:
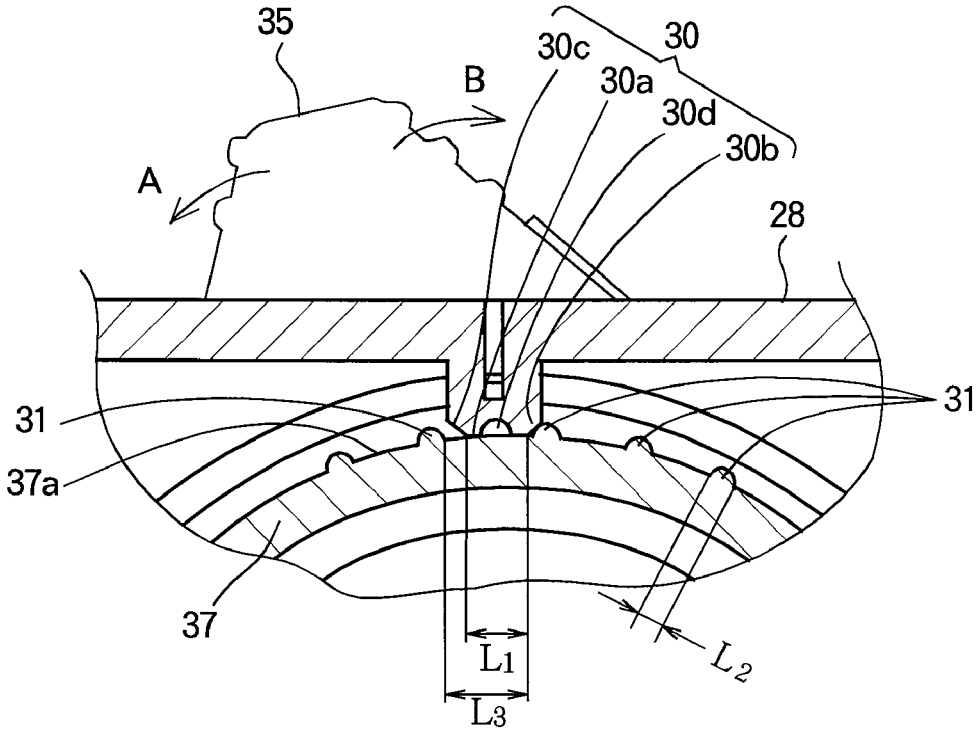
FIG. 19 illustrates a modification to the shape of the rib.

FIG. 19 illustrates a modification to the shape of the rib 30. Referring to FIG. 19, the rib 30 has a recess 30*d* formed in the flat surface 30*a*.

Figure 20:
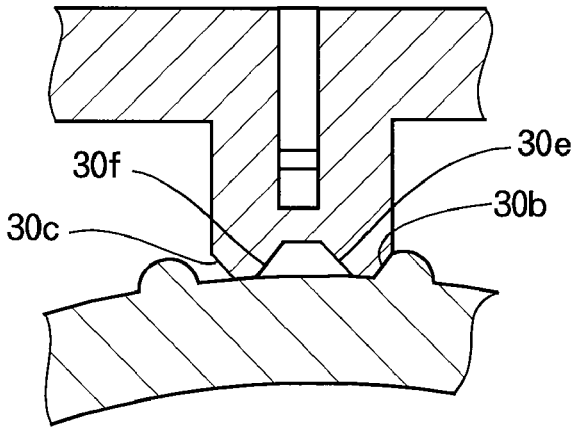
FIG. 20 is an enlarged view of the recess.

FIG. 20 is an enlarged view of the recess 30*d*. The recess has a cross section of a trapezoid with side walls 30*e* and 30*f*. The side walls 30*e* and 30*f* are substantially parallel to the side surfaces 30*c* and 30*b*, respectively.

Figure 21:
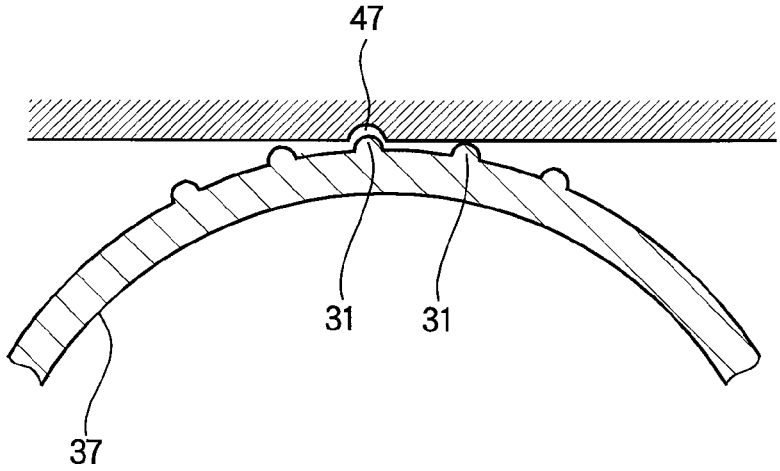
FIG. 21 illustrates a yet another modification in which the housing has a recess formed in the inner wall surface of the housing.

FIG. 21 illustrates a yet another modification in which the housing 28 has a recess 47 formed in the inner wall surface of the housing 28.

Second Embodiment

A second embodiment differs from the first embodiment in that curved guides 37 have recesses 33 formed in their outer curved surfaces 37*a*.

The first and second embodiments are substantially the same in the configuration of the image forming apparatus and the process cartridge 2.

Figure 22:
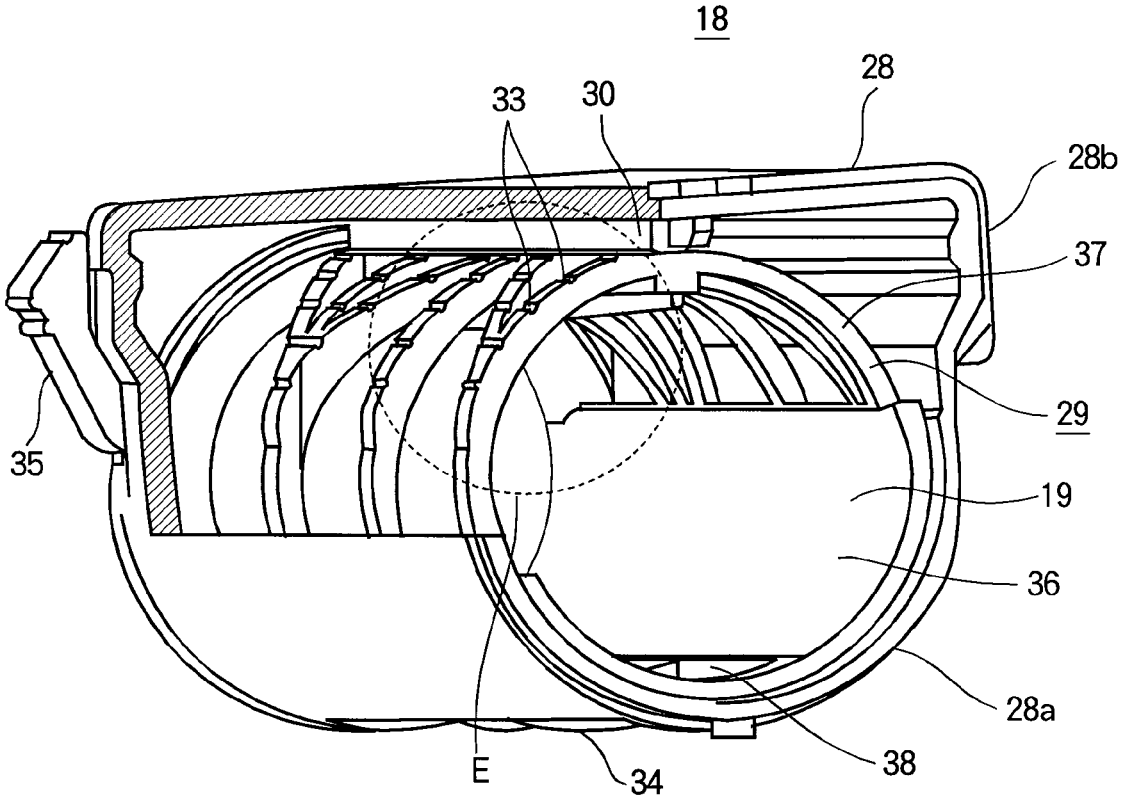
FIG. 22 is a perspective view of the housing shown in FIG. 6 with a portion of the housing cut away.
Figure 23:
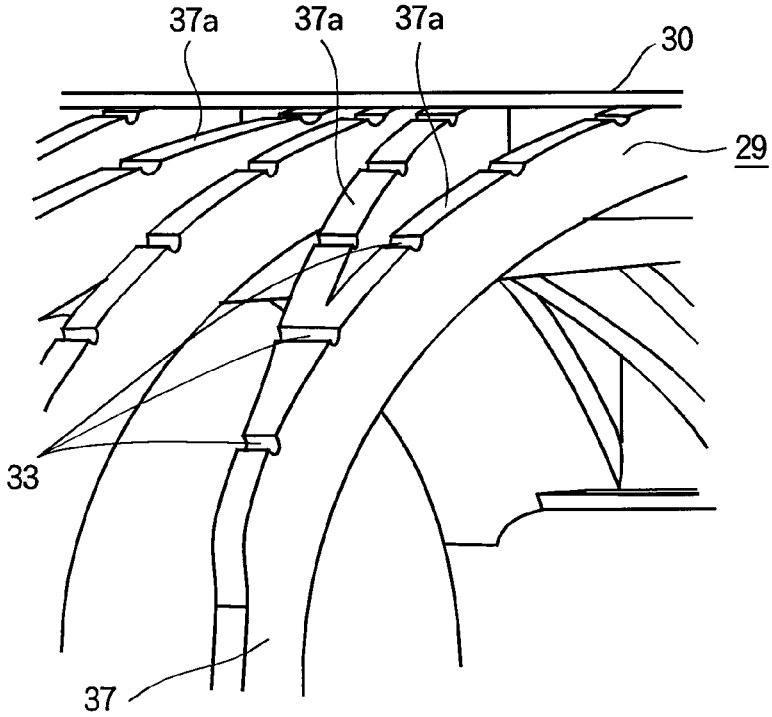
FIG. 23 is an enlarged view of a portion D of FIG. 22.
Figure 24:
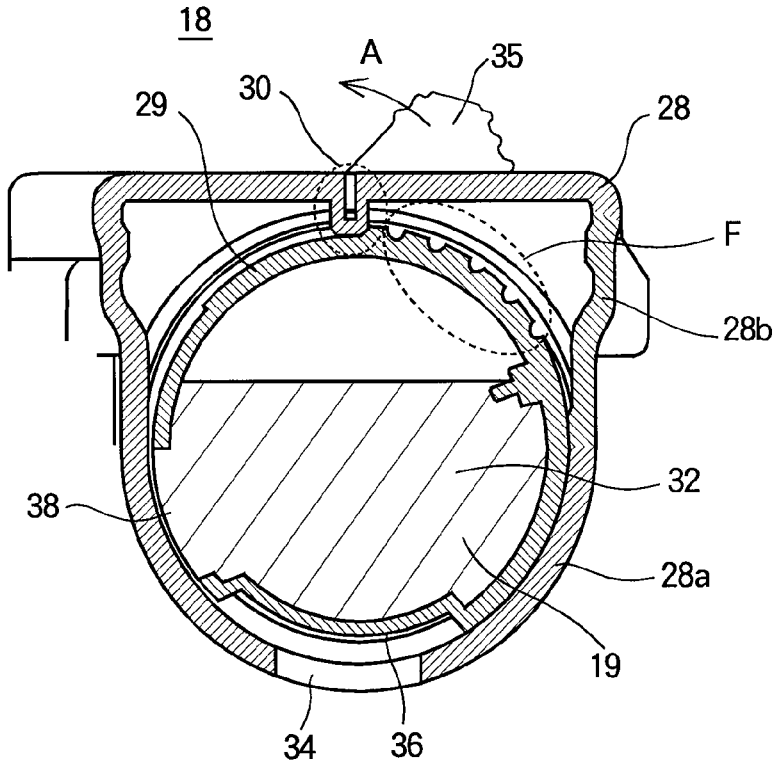
FIG. 24 is a simplified longitudinal cross-sectional view of the toner cartridge.
Figure 25:
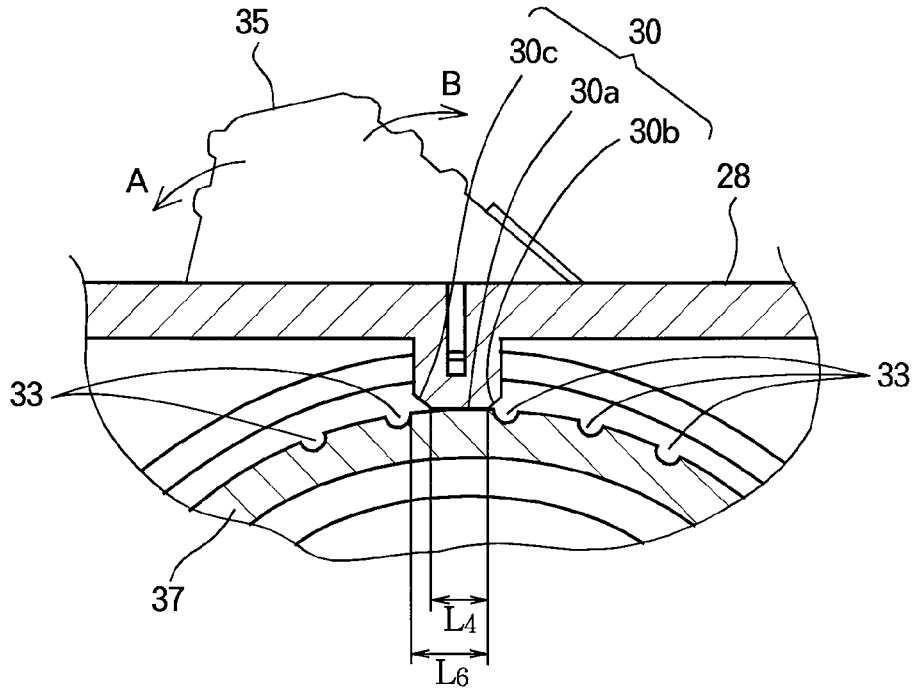
FIG. 25 is an enlarged cross-sectional view when a knob shown in FIG. 24 has been rotated in a direction shown by arrow A.

FIG. 22 is a partial perspective view of a housing 28 shown in FIG. 6 with a part of the housing 28 cut away. FIG. 23 is an enlarged view of a portion E of FIG. 22. FIG. 24 is a cross-sectional view of the toner cartridge 18. FIG. 25 is an enlarged cross-sectional view of a portion F of FIG. 24 when a knob 35 shown in FIG. 24 is being rotated in a direction shown by arrow A.

Referring to FIG. 22, a projection 30 is formed on an inner surface of the housing 28, and extends in a longitudinal direction of the housing 28. The projection 30 also extends toward the curved guides 37 of a shutter 29. The curved guides 37 are in the shape of a partial ring or an arc such that the outer curved surfaces 37*a* lie substantially in a cylindrical plane in which the outer surface of a shutter portion 36 lies.

The shutter 29 includes the shutter portion 36. When the shutter 29 rotates in sliding contact with the housing 28, the shutter portion 36 opens or closes an outlet 34 formed in the housing 28. The knob 35 is formed at a longitudinal end of the toner cartridge 18, and is in one piece with the shutter 29 or is assembled to the shutter 29 securely. Operating the rotary knob 35 to an opening position causes the shutter portion 36 to open an outlet 34 formed in the housing 28, allowing toner 32 to be supplied into the toner reservoir 20 of the process cartridge 2. Operating the knob 35 to a closing position causes the shutter portion 36 to close the outlet 34, ceasing to supply the toner 32 into the toner reservoir 20 as well as locking the toner cartridge 18 to the process cartridge 2.

The recesses 33 are formed in the outer curved surfaces 37*a* of the curved guides 37. The recesses 33 have a substantially semi-circular cross section, and extend in directions parallel to a rib 30 (FIG. 22) formed on an upper inner surface of the rectangular parallelpiped upper half 28*b* of the toner cartridge 18. At least one recess 33 needs to be formed in at least one of the curved guides 37. However, more of the recesses 33 should be formed in more of the curved surfaces 37*a* of the curved guides 37 for sufficient vibration.

The rib 30 includes a flat surface 30*a* and side surfaces 30*b* and 30*c* contiguous to the flat surface 30*a*. The side surfaces 30*b* and 30*c* form a tapered portion of the rib 30 (FIG. 25). The recesses 33 have a substantially semicircular cross section. As the shutter 29 rotates relative to the housing 28, the curved surfaces 37*a* slide on the rib 30. When the rib 30 presses the curved surfaces 37*a* down, the curved guide 37 deforms such that when the shutter 29 rotates relative to the housing 28, the edge of the recess 33 interferes with the edge of the rib 30 at which the flat surface 30*a* and the side surface 30*c* or 30*b* intersect. The interference of the edge of the recess 33 with the edge of the rib 30 causes the curved guide 37 to resiliently deform and then to disengage from the rib 30. The side surfaces 30*b* help the rib 30 exit the recess 33. Shortly after the rib 30 disengages from the edge of the recess 33, the curved guide 37 is released from the rib 30 to vibrate due to abrupt disengagement of the recess 33 from the rib 30. The shape and dimension of the rib 30 may be the same as those described in the first embodiment.

The flat surface 30*a* of the projection 30 includes a dimension L4 in a direction of rotation of the curved guide 37. The recesses 33 are spaced apart by a distance L6, which is longer than the dimension L4 of the flat surface 30*a*. Thus, when the shutter 29 rotates, the rib 30 will not extend over two adjacent recesses 33 simultaneously at any moment, thereby generating a sufficient amount of vibration of the shutter 29.

A description will be given of a portion of the second embodiment different from the first embodiment. Just as shown in FIG. 16B, operating the knob 35 in the A direction causes the shutter 29 to rotate relative to the housing 28, so that the shutter portion 36 gradually opens the outlet 34. This allows the toner 32 to be supplied gradually from the toner cartridge 18 into the toner reservoir 20 of the process cartridge 2. At the same time, a locking hook 46 (FIG. 14) gradually enters under a guide projection 43 to lock the toner cartridge 18 to the process cartridge 2.

When the curved guide 37 slides on the rib 30, the rib 30 interferes with the recess 33 to exert a force against the recess 33. As the user further rotates the knob 35 to overcome the force, the curved guide 37 is caused to resiliently deform until the rib 30 takes up a position between adjacent recesses 33 formed in each of the curved guides 37. As a result, the shutter 29 is subjected to a short vibration.

The rib 30 interferes with a plurality of recesses 33 formed in the outer curved surfaces 37*a* of the curved guides 37, both the shutter 29 and the housing 28 experience a series of short vibrations during rotation of the shutter 29. The series of short vibrations effectively shakes the toner 32 off various portions including the inner surface of the housing 28, upper corners of the housing 28, and outer curved surface 37*a* of the curved guides 37. This operation reduces the amount of the toner 32 that would otherwise remain in a toner chamber 19 after discharging the toner 32 into the process cartridge 2.

The second embodiment has been described with respect to a combination of the shutter 29 having curved guides 37 with the recesses 33 formed therein, and the housing 28 having the projection 30. The invention may be modified such that projections are formed in the curved guides 37 and recesses are formed in the inner surface of the housing 28.

Figure 26:
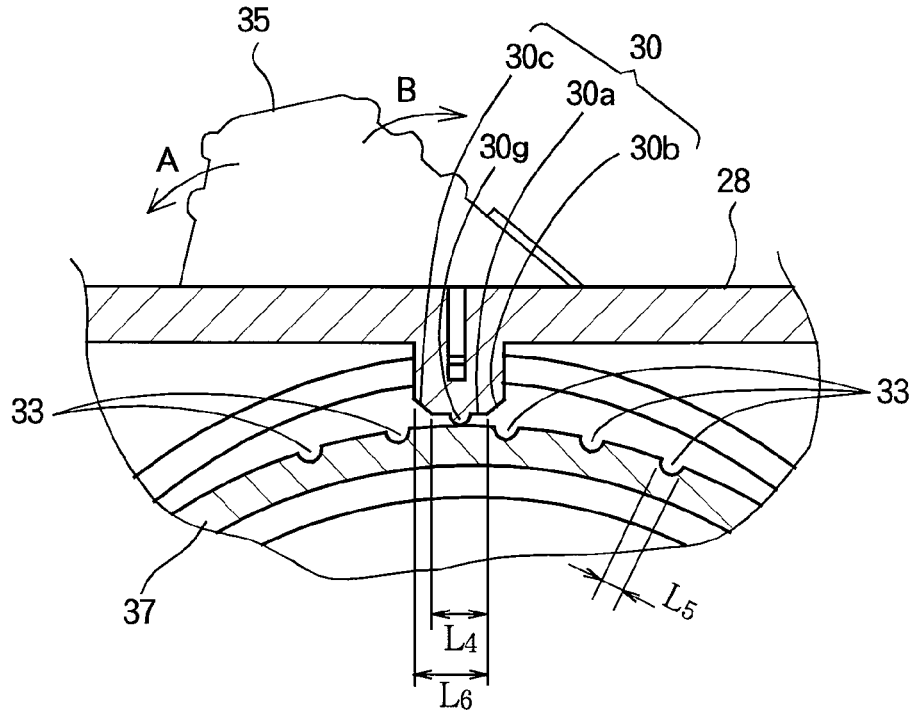
FIG. 26 illustrates a modification to the shape of the rib.

FIG. 26 illustrates a modification to the shape of the rib 30. Referring to FIG. 26, the rib 30 includes a projection 30*g* having a substantially semicircular cross section. The projection 30*g* and recesses 33 extend substantially in a longitudinal direction of the toner cartridge 18.

While the first and second embodiments have been described in terms of a toner cartridge detachably mounted to a process cartridge into which a developer is supplied from the toner cartridge, the invention may also the applicable to electrophotographic apparatuses including printers, facsimile machines, and multifunction printers. The developer material container of the invention may be applied to developing apparatuses including a developing device in which a toner container and a developing section are of a unit type, and a developer container that collects residual developer remaining on an image bearing body and an image-transferring mechanism. Such a developer container includes a developer chamber, an outlet through which the developer material is discharged, and a shutter member capable of opening and closing the outlet.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer material container that holds a developer material therein, the developer material container being attached to an image forming apparatus, the container comprising:

a housing that holds the developer material therein, the housing including a first engagement portion and an opening through which the developer material is discharged into the image forming apparatus, wherein the first engagement portion includes a first surface; and a shutter fitted into the housing and slidable relative to the housing, the shutter including a second engagement portion that alternately engages with and disengages from the first engagement portion when the shutter slides relative to the housing, and a shutter wall that either opens or closes the opening when the shutter slides relative to the housing, wherein the second engagement portion includes a second surface and either at least two projections formed on the second surface or at least two first recesses formed in the second surface, the at least two projections being spaced apart by the first surface and the at least two first recesses being spaced apart by the first surface, wherein the first surface of the first engagement portion is in sliding contact with the second surface between adjacent projections when the first surface is between the adjacent projections.

2. The developer material container according to claim 1, wherein the first engagement portion that projects from an inner wall of the housing toward the shutter, and the at least one second projection projects from the second surface toward the housing.

3. The developer material container according to claim 1, wherein the first engagement portion includes at least one second recess formed in the first surface, and the at least two projections project from the second surface toward the housing.

4. The developer material container according to claim 1, wherein the first engagement portion includes at least one first projection that projects from the first surface toward the shutter.

5. The developer material container according to claim 1, wherein the housing includes a substantially semi-cylindrical portion extending in a longitudinal direction, the semi-cylindrical portion including the opening formed therein, wherein the shutter wall is a semi-cylindrical wall and the second engagement portion includes a generally curved portion having the second surface, and is rotatable relative to the housing.

6. The developer material container according to claim 5, wherein the housing includes a substantially rectangular portion extending in a longitudinal direction, the rectangular portion being contiguous with the semi-cylindrical portion to form the housing, and the first surface is an inner surface of the rectangular portion so that the shutter is held in place by the first engagement portion and the substantially semi-cylindrical portion.

7. The developer material container according to claim 2, wherein when the shutter slides relative to the housing, the at least two projections engage the first engagement portion to cause the second engagement portion to resiliently deform so that the shutter further slides relative to the housing and then disengages from the first engagement portion to regain the original form after deformation.

8. The developer material container according to claim 7, wherein when the at least two projections disengage from the first engagement portion, the shutter vibrates.

9. The developer material container according to claim 1, wherein the at least two first recesses are two of a plurality of first recesses, wherein the first surface has a first dimension in a direction in which the shutter slides, and adjacent first recesses are spaced apart by a second dimension in a direction in which the shutter slides, the second dimension being larger than the first dimension.

10. The developer material container according to claim 1, wherein the at least two projections are two of a plurality of projections aligned in a direction in which the shutter slides relative to the housing and a distance between adjacent second projections is longer than a dimension of the first surface in the direction.

11. The developer material container according to claim 1, further comprising a locking mechanism that locks the developer container to the image forming apparatus in an interlocked relation with sliding motion of the shutter relative to the housing.

12. The developer material container according to claim 1, wherein the developer material container is detachably attached to the image forming apparatus.

13. The developer material container according to claim 1, wherein the developer is used to develop an electrostatic latent image formed on a photoconductive drum of the image forming apparatus.

14. An image forming apparatus incorporating the developer material container according to claim 1, wherein the image forming apparatus comprising:

an image bearing body;

a charging section that charges a surface of the image bearing body;

an exposing section that illuminates the charged surface of the image bearing body to form an electrostatic latent image;

a developing section that supplies the developer material to the electrostatic latent image to form a developer image;

a transfer section that transfers the developer image onto a print medium; and a fixing section that fixes the developer image on the print medium into a permanent image.

15. The developer material container according to claim 1, wherein when the shutter slides relative to the housing, the first engagement portion slides on the second engagement portion such that the developer container vibrates.

16. The developer material container according to claim 1, wherein the housing extends in a longitudinal direction thereof and the first engagement portion extends in a direction substantially parallel to a direction in which the housing longitudinally extends, wherein the first engagement portion extends substantially from one longitudinal end of the housing to the other longitudinal end of the housing;

wherein the second engagement portion is one of a plurality of second engagement portions disposed in an area extending substantially from one longitudinal end of the housing to the other longitudinal end of the housing.

17. The developer material container according to claim 1, wherein the shutter has a generally cylindrical body that includes the shutter wall generally in a shape of a partially cylindrical wall and a plurality of curved guides in the shape of a partial ring, each of the curved guides having the second surface and the projections formed thereon.

* * * * *